United States Patent [19]

Towlson

[11] Patent Number: 4,696,722

[45] Date of Patent: Sep. 29, 1987

[54] LOW COST TOOLING REPLICATION TECHNIQUE

[75] Inventor: Howard E. Towlson, Baldwinsville, N.Y.

[73] Assignee: General Electric Company, Princeton, N.J.

[21] Appl. No.: 843,439

[22] Filed: Mar. 24, 1986

[51] Int. Cl.[4] ..... C25D 1/10

[52] U.S. Cl. ..... 204/6

[58] Field of Search ..... 204/3, 4, 6

[56] References Cited

U.S. PATENT DOCUMENTS 2,441,747 5/1948 Beshgetoor ..... 204/6

4,363,705 12/1982 Hunyar ..... 204/12

OTHER PUBLICATIONS

Plastics and Rubber: Processing Dec. 1977, pp. 131-138.

*Primary Examiner*—T. M. Tufariello

*Attorney, Agent, or Firm*—Eugene M. Whitacre; Vincent J. Coughlin, Jr.

[57] ABSTRACT

A low cost tooling replication technique for producing glass pressing tools capable of producing precision complex optical surfaces is disclosed. A master glass pressing tool surface is first passivated and plated with nickel or other suitable material to a thickness sufficient to give the plated material some mechanical strength. The plated material is separated from the master glass pressing tool surface to reveal a negative of the master glass pressing tool surface. This negative surface is passivated and plated with nickel or other suitable material to a thickness sufficient to give the plated material some mechanical strength. The plated material is separated from the negative surface to reveal a replica of the master glass pressing tool surface. A plurality of platings may be made on the negative surface to produce a plurality of replicated master glass pressing surfaces. The replicated master glass pressing surfaces are provided with a backer. The backer may be electro-plated copper, for example, to provide good heat conduction from the glass pressing surface. The backer is attached to a flange for mounting in a press.

17 Claims, 8 Drawing Figures

LOW COST TOOLING REPLICATION TECHNIQUE

BACKGROUND OF THE INVENTION

1. Field of the Invention

This invention is generally directed to a process of precision molding glass surfaces to achieve desired optical qualities and, more particularly, to a low cost tooling replication technique for the manufacture of lens arrays and other complex optical surfaces.

2. Description of the Prior Art

The technology which gave rise to the subject invention is the technology of light valve projectors of the Schlieren dark field type. The principles and mechanisms of such light valve projectors are taught, for example, in U.S. Pat. No. 3,437,764 to Good et al. These light valve projectors include a lens system comprising an input window and an imaging lens which focuses filtered light from a high intensity lamp onto an input bar plate. The lens system comprises two arrays, each of which contains over 800 very small lenslets, which are accurately aligned to achieve the required focus of the arc light image within a transparent area of the input bar plate.

These lens arrays have been manufactured in the past by means of a precision machined stainless steel tool which is used in a glass press to form the lens arrays in molten glass. The tool is costly and time consuming to make, even when using numerically controlled machining techniques. The machined part must be hand polished to produce the final highly polished surface which has generally been considered necessary to produce a glass surface of the required optical qualities.

The process for producing the lens arrays, which comprise the input window and the imaging lens of light valve projectors of the Schlieren dark field type, is one of the contributing factors as to why the cost of these projectors has remained high for so many years. Many efforts have been made in the past to reduce the cost of manufacture of various components of light valve projectors, and great progress has been made in accomplishing this objective. However, what is needed is a method of producing lens array glass pressing tools in a cost and time efficient manner so that, in volume production, several such tools can be employed.

The technique of making a master mold which is used to make replicas by a plating process is the basic technique which is used in the phonograph record industry to make their plastic pressing molds. Plastic, however, is worked at a much lower temperature and is less abrasive than glass. Thus, the technique has not been applied to the glass pressing business. In fact, the prevailing wisdom in the glass industry is that only cast or machined tools can be used with success. In the case of a pressing where the mold costs are high and the mold life is not a major concern, i.e., a short manufacturing run of a thousand pieces versus a million pieces, the need for an inexpensive fast turn around method of generating glass pressing tools is important.

SUMMARY OF THE INVENTION

It is therefore an object of the present invention to provide a cost and time efficient technique for making glass pressing tools which are capable of producing tools of superior quality.

It is another object of the invention to provide a low cost tooling replication technique for the manufacture of complex precision optical surfaces.

It is a further object of the invention to provide glass pressing tools which are inexpensive to make yet produce quality optical surfaces and exhibit easy release from the glass.

According to the invention, these and other objects are attained by replicating a master tool through a process of plating. More specifically, the finished pressing surface of a master tool is first passivated and then electroplated with a suitable metal to a thickness sufficient to give the plated material some mechanical strength, i.e., about 0.1 inch. The plated surface is then removed to reveal a negative of the tool surface. This negative is then passivated and plated with a suitable metal to approximately 0.1 inch thickness, and the two surfaces are separated. In this case, what is meant by a suitable metal is a metal selected to withstand the temperatures of the molten glass being pressed. As a specific example, in one implementation of the invention nickel was used as the plating metal. The second plating is identical to the master tool surface. A backing is then provided to this second plating. The backing was made in one implementation of the invention by plating copper to a thickness of approximately one inch. Other materials could also be used if they could be plated to a relatively thick section. A backer could also be attached by other techniques such as brazing or casting; however, plating was tried first and proved successful. The resulting structure is then attached to a suitable flange for press mounting.

Using this technique, it is possible to quickly and inexpensively make many glass pressing tools from a single master tool. The master tool is stored in a safe place after the negative is made, and any number of positive platings can be made from this negative.

Not only does the technique according to the invention produce inexpensive glass pressing tools, the resulting tools exhibit superior characteristics to the originally used machined tools. Specifically, because of the way the glass pressing tools of the invention are made with a backer plated to or otherwise attached to the plated replication of the master tool, the heat transfer characteristics of the tool can be tailored for best results. In addition, a wider range of materials are available for the pressing surface and may be chosen, in combination with the backer material, to achieve a superior release of the tool from the glass in the pressing operation. Moreover, the replicated tool surface may be overplated with still another metal to improve its wear characteristics.

While the technology which gave rise to the invention is the light valve projector technology generally described in the Good et al patent, the invention has much broader application than that particular technology. In general, the invention can be used to great advantage in the volume production of pressed complex optical glass surfaces such as, for example, automobile head light lenses and the like.

BRIEF DESCRIPTION OF THE DRAWINGS

The foregoing and other objects, aspects and advantages of the invention will be better understood from the following detailed description of a preferred embodiment with reference to the drawings, in which.

DETAILED DESCRIPTION OF THE PREFERRED EMBODIMENT OF THE INVENTION

Figure 1:
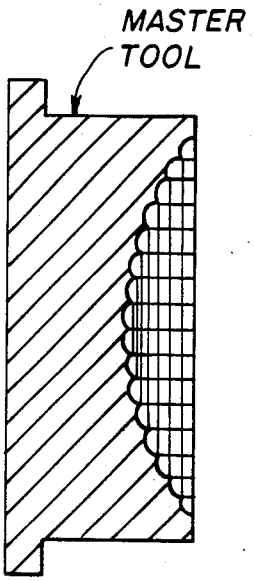
FIG. 1 is a plan view in cross-section showing a master tool for pressing a lens array.

Referring now to the drawings, and more particularly to FIG. 1, there is shown an example of a master tool used to press the lens array of the input window of a light valve of the Schlieren dark field type. This tool is manufactured in the conventional manner as by machining a billet of stainless steel and polishing the concave surfaces which form each lens of the lens array. The pressing surface of the tool is passivated. Potassium dichromate may be used to accomplish the passivation, but other techniques known in the electro-plating art may be used. The purpose of the passivation is to provide an interface boundary between the master tool surface and material which is plated to that surface.

Figure 2:
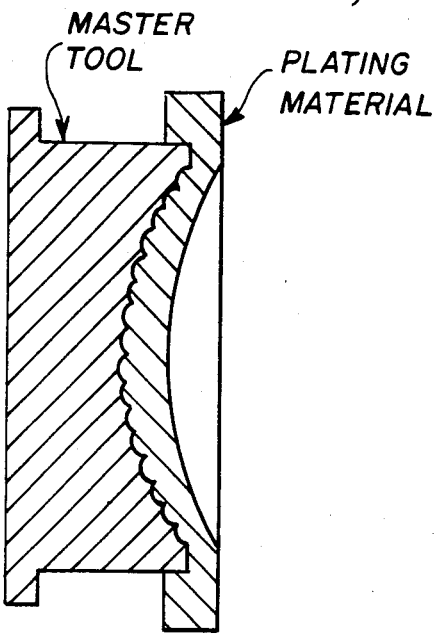
FIG. 2 is a view similar to FIG. 1 showing the master tool surface plated with a plating material in the first step of replicating the tool surface.

In FIG. 2, the master tool has been plated with a plating material to a thickness which is sufficient to give the plated material some mechanical strength. The exact thickness is not critical, but a thickness of approximately 0.1 inch has been found to be sufficient for nickel. In the actual practice of the invention, nickel is used as the plating material, but various other metals and alloys may be used.

Figure 3:
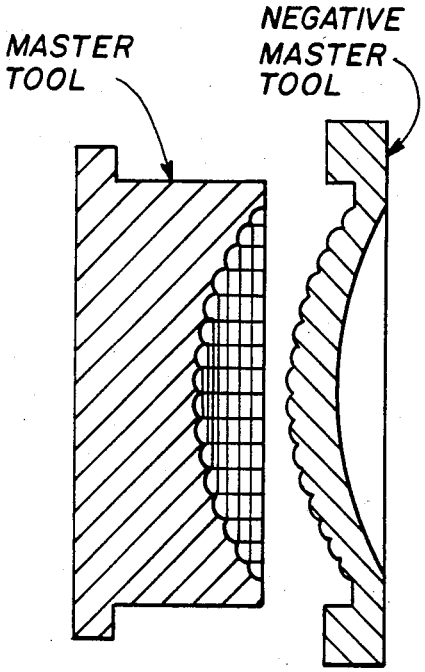
FIG. 3 is a view similar to FIG. 2 but showing the plated negative surface separated from the master tool surface.

In FIG. 3, the plated surface has been separated from the master tool to reveal a negative of the master tool glass pressing surface. At this point, the master tool can be put in a safe place to protect it from damage since all further processing to replicate its glass pressing surface is accomplished without it.

Figure 4:
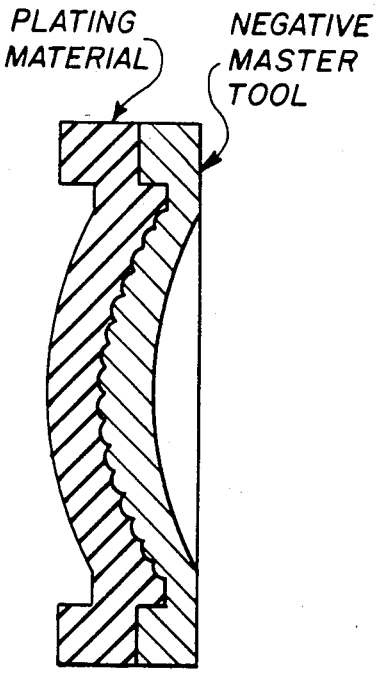
FIG. 4 is a plan view in cross-section showing the plated negative surface plated with a plating material.

The plated negative surface which was separated from the master tool now becomes the new "master" from which the actual glass pressing tools are replicated. This is shown in FIG. 4 where the negative is plated with a suitable plating material to a desired thickness. In this case, by suitable plating material what is meant is a metal selected to withstand the temperatures of the glass being pressed. For example, nickel or a so called "hard" nickel such as a nickel and cobalt alloy may be used. Other suitable plating materials include platinum, members of the platinum family and chromium. In addition, it is possible to use other "softer" metals, such as copper provided that the basic temperature requirements are met and the plated surface is overplated with, for example, chromium, platinum or rhodium to improve its wear characteristics. As before, the surface of the negative is passivated before being plated. The plating material may be the same or different than that which was used in making the negative. In an implementation of the invention, the same plating material was used, i.e., nickel, and the plating thickness as again about 0.1 inch.

Figure 6:
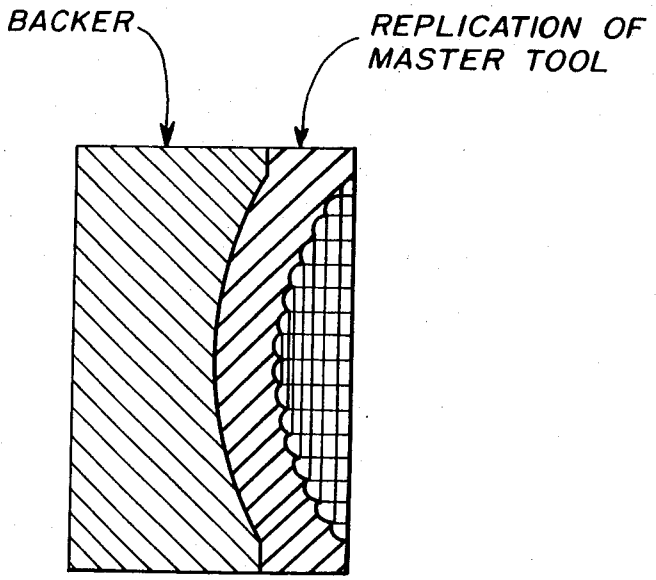
FIG. 6 is a plan view in cross-section with a built-up backer material to provide stength and heat transfer characteristics desirable in a glass pressing tool.
Figure 5:
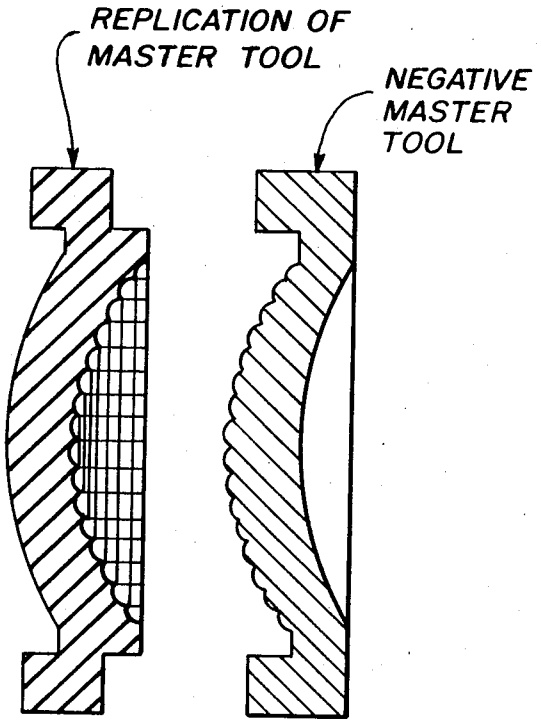
FIG. 5 is a view similar to FIG. 4 showing the second plated material separated from the plated negative surface to reveal a positive replication of the master tool surface.

When the plating process is completed as shown in FIG. 4, the two plated surfaces are separated as shown in FIG. 5 to reveal an exact replication of the original master tool surface. This replication is then provided with a backer as shown in FIG. 6. FIG. 6 represents the tool after machining the backer and the outer periphery of the replicated tool surface prepatory to mounting the tool. In an implementation of the invention, the backer was built up by electroplating copper to a thickness of approximately one inch. Copper was used because of its excellent thermal conducting properties. Furthermore, the electro-plated copper provides mechanical support for the plated nickel pressing surface. It will of course be recognized that other materials besides copper may be used for the backer including, but not limited to, nickel.

Figure 8:
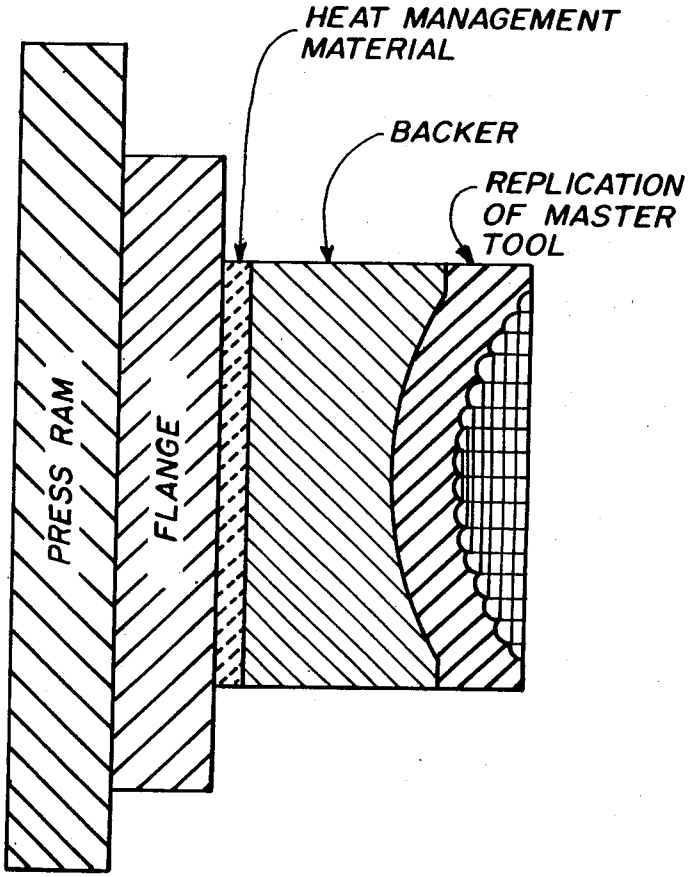
FIG. 8 is a plan view in cross-section showing the glass pressing tool made according to the present invention attached to a glass pressing ram.
Figure 7:
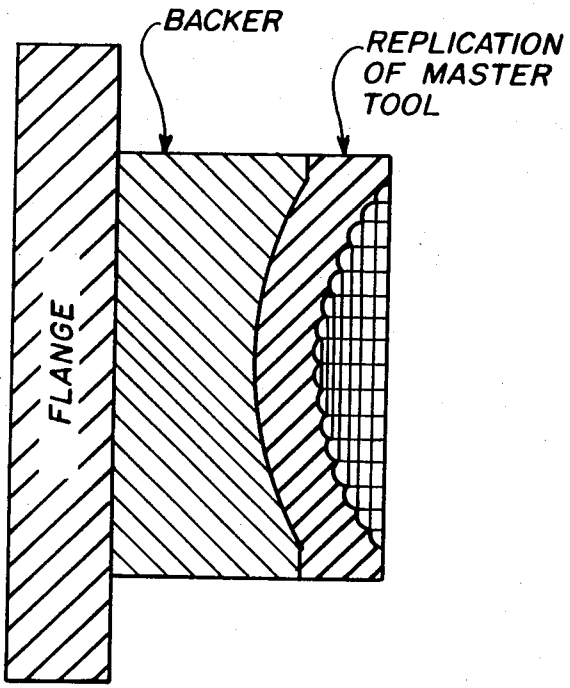
FIG. 7 is a view similar to FIG. 6 showing the backer material attached to a suitable flange for press mounting.

The plated pressing surface and its backer is finished by machining off unneeded material to produce the structure shown in FIG. 6. This structure is then attached to a suitable flange for mounting on the glass press as shown in FIG. 7. FIG. 8 shows the assembly of FIG. 7 mounted on the press ram.

As a specific example, a pressing run was made using a replicated tool to form a lens array in an alkali barium glass (Corning 9025 glass). The tool was made of a plated nickel surface with a copper backer. Typical glass working temperature for Corning 9025 glass is around 1000° C. with mold surface temperatures of approximately 400° to 500° C. Excellent glass release was obtained from the nickel surface.

One of the advantages of the construction of the glass pressing surface according to the invention is the possibility of adjustment of heat management in the mold by either changing the flange material or sandwiching between the backer and the flange a material which will alter the heat conduction from the mold press surface out through the flange base. This latter possibility is shown in FIG. 8. In general, because the mold press is a composite structure, it is possible to tailor the device for specific conditions.

The foregoing methods of tool manufacture do not preclude the possibility of plating a thin layer of preferred material onto the replicated nickel working surface. This is presently being done in the industry to give the working surface better wear characteristics. Such preferred material could include chromium, platinum and rhodium, for example.

While the invention has been described in terms of a specific preferred embodiment, those skilled in the art will recognize that the invention can be practiced with modification and variation within the terms of the appended claims.

Having thus described my invention, what I claim as new and desire to secure by Letters Patent is as follows:

1. A method of replicating glass pressing tools capable of producing precision complex optical surfaces in molten glass comprising the steps of:

passivating a master glass pressing surface which is to be replicated;

plating a metal on said master glass pressing surface to a thickness sufficient to give the plated metal mechanical strength;

separating the plated metal from said master glass pressing surface to reveal a negative master surface;

passivating said negative master surface;

plating the negative master surface with a plating metal selected to withstand a glass working temperature of around 1000° C. and the abrasive properties of a molten glass being pressed to a thickness sufficient to give the plated metal mechanical strength; and separating the plated metal from said negative master surface to reveal a replication of said master glass pressing surface.

2. The method according to claim 1 further comprising the step of providing a backer for said replicated master glass pressing surface.

3. The method according to claim 2 wherein the step of providing a backer for said replicated master glass pressing surface is performed by plating a material exhibiting a good heat conduction to the back of said replicated master glass pressing surface.

4. The method according to claim 3 wherein the material plated to the back of said replicated master glass pressing surface is copper.

5. The method according to claim 4 wherein the replicated master glass pressing surface is nickel plated to a thickness of approximately 0.1 inch and the copper backer is plated to a thickness of at least approximately one half inch.

6. The method according to claim 2 further comprising the step of attaching the backer to a flange for mounting in a press.

7. The method according to claim 6 wherein the backer is directly mounted to said flange in direct thermal contact therewith.

8. The method according to claim 6 wherein the backer is mounted to said flange by means of an intermediate material chosen to alter the heat conduction from said replicated master glass pressing surface to said flange.

9. The method according to claim 2 wherein the plated material of the replicated master glass pressing surface and the backer are different materials.

10. The method according to claim 1 further comprising the step of overplating the replication of said master glass pressing surface with a material to improve the wear characteristics of said replication.

11. The method according to claim 1 further comprising the steps of repeating the steps of passivating said negative surface, plating a material to said passivated negative surface and separating the plated material from said negative surface a plurality of times to make a plurality of replicated master glass pressing surfaces.

12. A method of replicating glass pressing tools capable of producing precision complex optical surfaces in molten glass comprising the steps of:

passivating a master glass pressing surface which is to be replicated;

plating a material on the passivated master glass pressing surface to a thickness sufficient to give the plated material mechanical strength;

separating the plated material from said passivated master glass pressing surface to reveal a negative master surface;

passivating said negative master surface;

plating the passivated negative master surface with a plating material selected from the group consisting of nickel, nickel alloy, platinum, members of the platinum family and chromium to a thickness sufficient to give the plated material mechanical strength; and separating the plated material from said negative master surface to reveal a replication of said master glass pressing surface.

13. The method according to claim 12 wherein the steps of passivating are performed by coating the surfaces to be passivated with a solution of potasium dichromate.

14. The method according to claim 12 wherein the materials plated on the master glass pressing surface and on the negative master surface are the same.

15. The method according to claim 14 wherein the materials plated are nickel.

16. A glass pressing tool with a replicated master glass pressing surface according to claim 12.

17. The glass pressing tool as recited in claim 16 wherein said glass pressing surface comprises a plurality of concave surfaces arranged in a matrix array, each of said concave surfaces corresponding to a lenslet of a lenticular lens array.

* * * * *